US006905376B2

(12) United States Patent
Chen

(10) Patent No.: US 6,905,376 B2
(45) Date of Patent: Jun. 14, 2005

(54) TERMINAL

(75) Inventor: Ping Chen, West Bloom Field, MI (US)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/823,909

(22) Filed: Apr. 13, 2004

(65) Prior Publication Data

US 2004/0209527 A1 Oct. 21, 2004

(30) Foreign Application Priority Data

Apr. 15, 2003 (JP) ..... 2003-110920

(51) Int. Cl.[7] ..... H01R 13/11
(52) U.S. Cl. ..... 439/852; 439/595
(58) Field of Search ..... 439/595, 752, 439/844–846, 851, 854, 853, 852

(56) References Cited

U.S. PATENT DOCUMENTS

| | | | | |
|---|---|---|---|---|
| 5,941,741 | A | 8/1999 | Dobbelaere et al. | |
| 6,152,788 | A | 11/2000 | Hata et al. | |
| 6,174,208 | B1 * | 1/2001 | Chen | 439/852 |
| 6,375,501 | B1 * | 4/2002 | Kojima | 439/595 |
| 6,390,860 | B2 * | 5/2002 | Shirouzu et al. | 439/752.5 |
| 6,672,910 | B2 * | 1/2004 | Hotea | 439/843 |

FOREIGN PATENT DOCUMENTS

| | | |
|---|---|---|
| EP | 1180816 | 2/2002 |
| JP | 3-9256 | 3/1991 |
| JP | 08007964 | 1/1996 |
| JP | 11283688 | 10/1999 |
| JP | 2000091022 | 3/2000 |
| JP | 2000231956 | 8/2000 |
| JP | 2000268907 | 9/2000 |

* cited by examiner

*Primary Examiner*—Gary Paumen
*Assistant Examiner*—James R. Harvey
(74) *Attorney, Agent, or Firm*—W. F. Fasse; W. G. Fasse

(57) ABSTRACT

The objective is to provide a terminal that can be used in waterproof electric connectors without damaging the sealing member thereof and can reliably prevent the body and the spring from being deformed through reducing the load on the body and enhancing the strength of the body. The terminal according to the present invention comprises a rectangular-tube-shaped body being formed of a cross plate, a first vertical plate and a second vertical plate bending from both ends in the width direction of the cross plate and rising to one side in the thickness direction, an inner plate bending from the first vertical plate and extending in the width direction close to the second vertical plate, and an outer plate bending from the second vertical plate and extending in the width direction close to the first vertical plate to overlap with the inner plate, a connecting part extending from the body, and a laid-down protruding piece bending from the end in the width direction of the outer plate of the body to reverse in the width direction, extending in the width direction and having a width equal to or narrower than the width of the outer plate.

20 Claims, 8 Drawing Sheets

TERMINAL

BACKGROUND OF THE INVENTION

1. Field of the Invention

This invention belongs to the field of terminals of electric connectors and relates to a terminal having a laid-down protruding piece that exhibits at least one function of a function of guiding the terminal to a predetermined position inside a receiving cell of a housing when the terminal is to be inserted into the receiving cell, a function of being fitted on a flexible piece of the housing and a function of preventing the terminal from being inserted into the housing the other way.

2. Related Art

Japanese Patent Unexamined Publication 2000-231956 discloses a female-type terminal of electric connector. The front half of this female-type terminal is approximately formed into a box shape so that the front half can be inserted into a receiving cell of a housing, a port is opened in the front end thereof for accepting a male-type terminal, a connecting part to be connected with an electric wire is provided in the rear thereof, and a contact spring, of which top end extending frontward to press and contact the male-type terminal, is provided inside the female-type terminal. Moreover, the above-mentioned front half comprises a bottom wall, side walls rising, respectively, from both ends in the width direction of the bottom wall, an outer top wall extending from the upper edge of one side wall toward the upper edge of the other side wall and an inner top wall extending from the upper edge of the latter side wall toward the upper edge of the former side wall, the outer top wall lapping on the inner top wall. A spring protection part is formed on the inner top wall by drawing so that the spring protection part drops on the front side of the top end of the contact spring. This Japanese Patent Unexamined Publication 2000-231956 discloses a stabilizer that is provided on the outer top wall. When the female-type terminal is inserted into a receiving cell of a housing, this stabilizer will be inserted into a groove being made upward in the top wall of the receiving cell and extending in the front-rear direction. The stabilizer will be advanced to go beyond a lance that is formed in the front part of the groove to flex in the width direction. Eventually, the stabilizer will be set on the front side of the lance and fitted on the lance.

Japanese Utility Model Examined Publication Heisei 3-9256 discloses a female-type terminal having an electric contact part. The terminal is formed by bending a conductive plate into a rectangular tube having a bottom wall, both side walls and a top wall. The electric contact part is formed by lapping a retaining piece over the free end of the top wall, the retaining piece being formed by bending an extended part of one side wall. In this female-type terminal, a protrusion is formed on either the free end part of the top wall or the retaining piece, and an overlapping part is formed by the top wall free end part and the retaining piece contacting each other through the protrusion. The retaining piece prevents the female-type terminal from being inserted into the housing the other way.

Japanese Patent Unexamined Publication Heisei 11-283688 discloses a terminal, wherein a flexible fitting piece of a box-shaped terminal fitting member is fitted on a shoulder of a rectangular-tube-shaped electric contact part having a bottom wall being one end of a flat plate, and the insertion position of the terminal inside the terminal receiving cell can be detected. In this terminal an extending plate is continuously provided on one side wall of the above-mentioned electric contact part, the extending plate is folded double on the top wall side of the electric contact part to form a stabilizer, a notch for the stabilizer is formed in one side wall of the above-mentioned terminal fitting member, and after a fitting craw formed on the free end of the above-mentioned flexible fitting piece and the above-mentioned shoulder are fitted together, the notch is fitted on the stabilizer. In the case of this terminal, as the terminal fitting member is made to fit on both the stabilizer of the terminal and the shoulder, the force of fitting the terminal by means of the terminal fitting member is enhanced.

Japanese Patent Unexamined Publication Heisei 8-7964 discloses a terminal for waterproof connector, wherein a slant insertion guiding part is formed by notching both side walls from the intermediate part of the front end of an accepting part toward the top end of the bottom plate. When this terminal is made to pass through an insertion hole of a waterproof plug, the terminal will gradually expand and open the insertion hole. Hence the terminal does not damage the insertion hole nor deteriorate the sealing performance of the waterproof plug.

Japanese Patent Unexamined Publication 2000-91022 discloses a waterproof connector comprising a housing having a holding part, into which terminals with electric wires fixed thereto are inserted and held and a seal setting part on the rear side of the holding part, an elastic soft sealing member, of which front face is made to contact the rear face of the seal setting part of the housing and in which terminal and electric wire insertion holes are formed, and a holder having a holding part contacting the rear face of the sealing member to hold it, a locking part to be locked on the housing while holding the sealing member and terminal and electric wire insertion holes. In the case of this waterproof connector, the above-mentioned terminal is a rectangular terminal, and a stabilizer for preventing reverse insertion is formed on one of the four faces of the terminal. The stabilizer is provided in the form of a protrusion stamped from the inner face toward the outer face. In this waterproof connector, when the terminal is inserted into the terminal and electric wire insertion hole of the sealing member or when the terminal is pulled out of the terminal and electric wire insertion hole of the sealing member, the stabilizer of the terminal will not be hooked on the inlet or the outlet of the terminal and electric wire insertion hole. Thus cracks are hardly formed in the terminal and electric wire insertion hole.

Japanese Patent Unexamined Publication 2000-268907 discloses a female-side terminal member, wherein an opening, into which a counterpart male terminal can be inserted, is formed in the top end of a box-shaped body being formed by bending a metal plate. In the case of this female-side terminal member, the edges of the above-mentioned opening are rounded by folding back extended pieces being extended on the top end of the body toward the inside. When this female-side terminal member is made to pass through an insertion hole of, for example, a waterproof rubber plug, the waterproof rubber plug can be prevented from being damaged.

SUMMARY OF THE INVENTION

Let us assume the terminals disclosed by Japanese Patent Unexamined Publication 2000-231956, Japanese Utility Model Examined Publication Heisei 3-9256 and Japanese Patent Unexamined Publication Heisei 11-283688 are used in waterproof electric connectors. In the cases of the terminal disclosed by Japanese Patent Unexamined Publication 2000-231956 and the terminal disclosed by Japanese Patent Unexamined Publication Heisei 11-283688, the stabilizer protrudes markedly from the terminal body of a rectangular tube shape. Hence the stabilizer poses a problem of damaging the circumferential wall of the hole of the sealing member when the terminal is made to pass through the sealing member of the electric connector. In that case, such a countermeasure as disclosed in Japanese Patent Unexamined Publication 2000-91022 may be taken. However, as the stabilizer is stamped in the form of a protrusion from the inner face toward the outer face, the strength of the rectangular-tube-shaped body will be lowered. In the case of the terminal disclosed by Japanese Utility Model Examined Publication Heisei 3-9256, the retaining piece is formed by bending an extended part of a side wall. When the terminal is inserted into the housing, if a force is exerted from the housing to the retaining piece, the side wall will be directly subjected to this force, which might result in deformation of the side wall, or when a spring is present inside the body, the spring might be deformed.

The present invention was made in view of these points, and its objective is to provide a terminal, wherein a rectangular-tube-shaped body of the terminal comprises a cross plate, two vertical plates rising from both ends in the width direction of the cross plate, and an inner plate and an outer plate both extending from the vertical plates in the width direction to overlap each other to secure the strength of the terminal, the terminal is provided with a laid-down protruding piece bending from the end in the width direction of the outer plate to reverse in the width direction and extending in the width direction, the laid-down protruding piece is made to exhibit at least one function of a function of guiding the terminal to a predetermined position inside the receiving cell, a function of being fitted on a flexible piece of the housing and a function of preventing the terminal from being inserted into the housing the other way, the amount of protrusion of the laid-down protruding piece from the body is kept small so that the terminal can be used in waterproof electric connectors without damaging sealing members, the bending moment that works on the root end of the laid-down protruding piece is kept small to reduce the load on the body, and this effect and the enhanced strength of the body due to the use of the above-mentioned structure in combination can reliably prevent deformation of the body and the spring.

To accomplish the above-mentioned objective, the terminal according to the present invention comprises, when a depth direction, a width direction and a thickness direction all being perpendicular to each other are assumed, a rectangular-tube-shaped body having an opening or a tab at the front in the depth direction thereof and having a cross plate, a first vertical plate and a second vertical plate bending from both ends in the width direction of the cross plate and rising to one side in the thickness direction, an inner plate bending from the first vertical plate and extending in the width direction close to the second vertical plate, and an outer plate bending from the second vertical plate and extending in the width direction close to the first vertical plate to overlap with the inner plate, a connecting part extending from the body rearward in the depth direction and to be connected to a conductor, and a laid-down protruding piece bending from the end in the width direction of the outer plate of the body to reverse in the width direction, extending in the width direction and having a width equal to or narrower than the width of the outer plate.

The housing is provided with a receiving cell penetrating the housing in the depth direction, when necessary with a guide groove concaving in the thickness direction from the receiving cell and extending in the depth direction, and when necessary with a flexible piece extending into the receiving cell or the guide groove. When the terminal is inserted into the receiving cell of the housing, if the guide groove is provided, the laid-down protruding piece will be guided by the guide groove to move frontward in the depth direction, and if the flexible piece is provided, the laid-down protruding piece will push away the flexible piece in the thickness direction and come to the front side in the depth direction of the flexible piece. Then the flexible piece will undergo elastic restoration to come to the rear side in the depth direction of the laid-down protruding piece to fit on it. Moreover, for example, when necessary the terminal and the receiving cell may be designed to be unsymmetrical when seen in the depth direction. In this case, the terminal can be inserted only when the orientation of the terminal and that of the receiving cell match with each other. Thus when the orientation of the terminal is reversed in the thickness direction, the terminal can not be inserted, and insertion of the terminal in a wrong orientation can be prevented. In short, the laid-down protruding piece exhibits at least one function of the function of guiding the terminal to the predetermined position inside the receiving cell, the function of being fitted on the flexible piece of the housing and the function of preventing the terminal from being inserted into the housing the other way.

In that case, as the body is formed into a rectangular tube with the cross plate, the first vertical plate and the second vertical plate both bending from the cross plate, the inner plate and the outer plate both bending from the vertical plates and overlapping each other, the strength of the terminal is assured by this arrangement. As the laid-down protruding piece bends from the end in the width direction of the outer plate of the body to reverse in the width direction, then extends in the width direction and has a width that is equal to or narrower than the width of the outer plate, the amount of protrusion of the laid-down protruding piece from the body is smaller. Hence when the terminal is used for a waterproof electric connector, even when the terminal is passed through a sealing member of the waterproof electric connector, the terminal will not damage the circumferential wall of the hole of the sealing member. Moreover, as the bending moment acting on the root end of the laid-down protruding piece is smaller, the load on the body will be reduced. This effect and the enhanced strength of the body due to the use of the above-mentioned structure in combination reliably prevent deformation of the body and the spring.

In the terminal of the present invention, a rectangular-tube-shaped body of the terminal comprises a cross plate, two vertical plates rising from both ends in the width direction of the cross plate, and an inner plate and an outer plate both extending from the vertical plates in the width direction to overlap each other to secure the strength of the terminal, and the terminal is provided with a laid-down protruding piece bending from the end in the width direction of the outer plate to reverse in the width direction and extending in the width direction. The laid-down protruding piece is made to exhibit at least one function of a function of guiding the terminal to a predetermined position inside the receiving cell, a function of being fitted on a flexible piece of the housing and a function of preventing the terminal from being inserted into the housing the other way. Moreover, the terminal can be used in a waterproof electric connector without damaging the sealing member and the terminal can be used as a common part for both a waterproof electric connector and a nonwaterproof electric connector. The bending moment that works on the root end of the laid-down protruding piece is kept small to reduce the load on the body, and this effect and the enhanced strength of the body due to the use of the above-mentioned structure in combination have provided successfully a terminal that can reliably prevent deformation of the body and the spring.

DESCRIPTION OF THE PREFERRED EMBODIMENTS OF THE INVENTION

Figure 7:
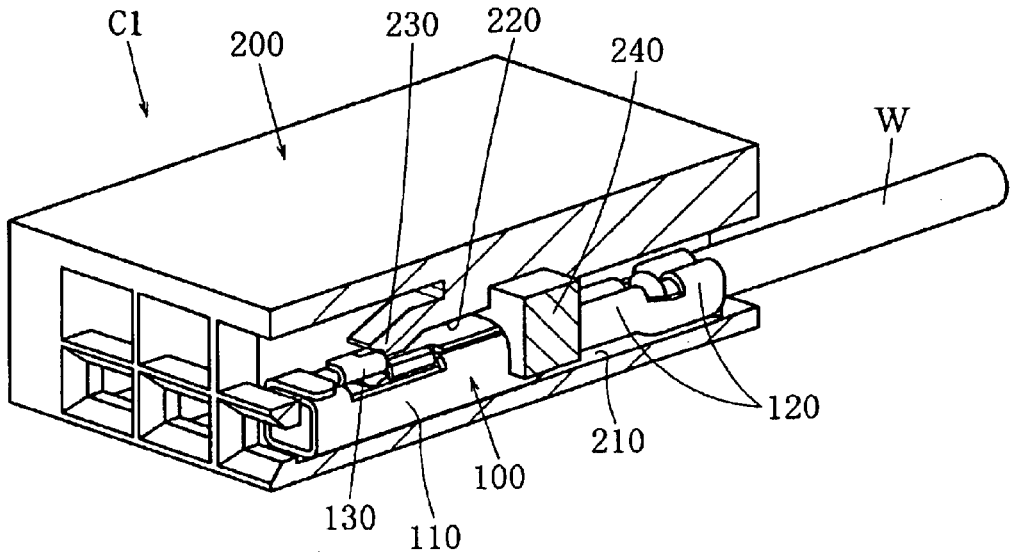
FIG. 7 is a perspective view showing in section a nonwaterproof electric connector of the first embodiment.

Some embodiments of the present invention will be described in the following. FIG. 1 through FIG. 6 show a terminal 100 being the first embodiment of the present invention. This terminal 100 is a female-type terminal. This terminal 100 is formed by folding a blank of a certain configuration. This blank is obtained by working such as blanking a thin plate of a certain thickness. As shown in FIG. 7, the terminal 100 is connected to an electric wire W being a conductor, then the terminal 100 is inserted into a receiving cell 210 of a housing 200 having the receiving cells 210 as will be described later and fitted on the housing 200. This completes a nonwaterproof electric connector C1 or a waterproof electric connector C2.

Figure 1:
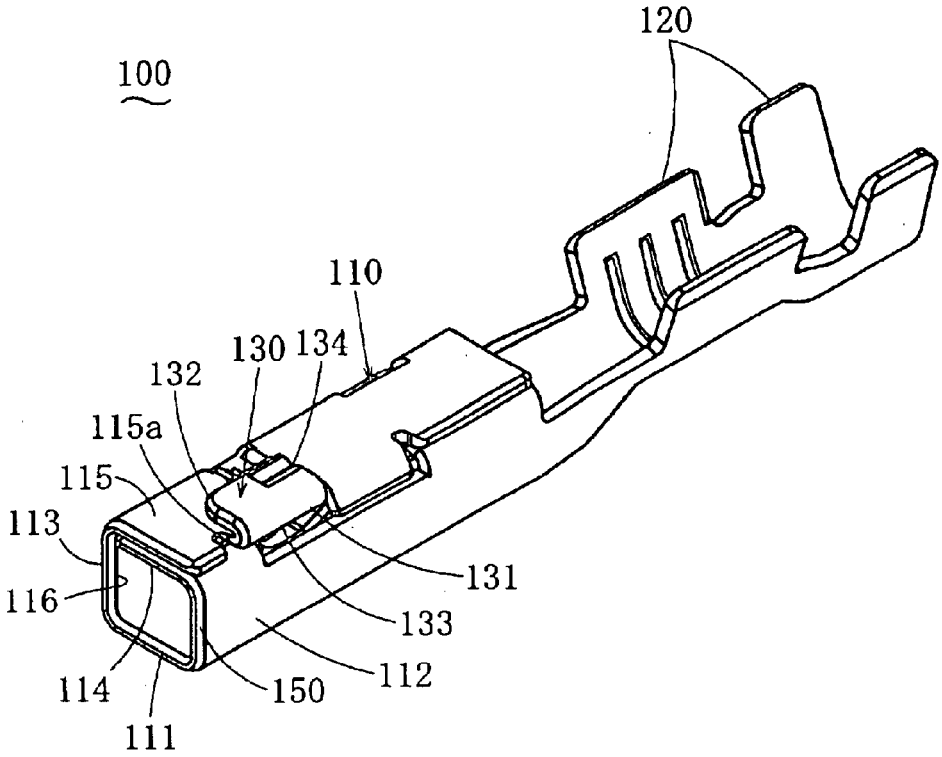
FIG. 1 is a perspective view showing the terminal of the first embodiment.
Figure 2:
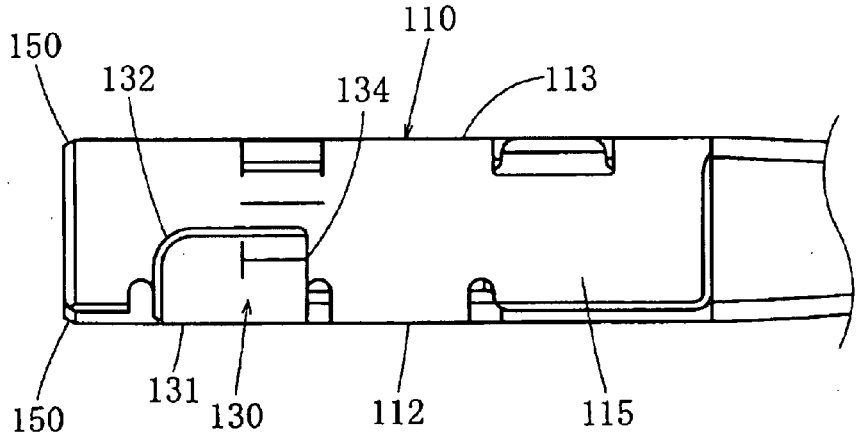
FIG. 2 is an enlarged partial view of the terminal of the first embodiment seen in the thickness direction.
Figure 3:
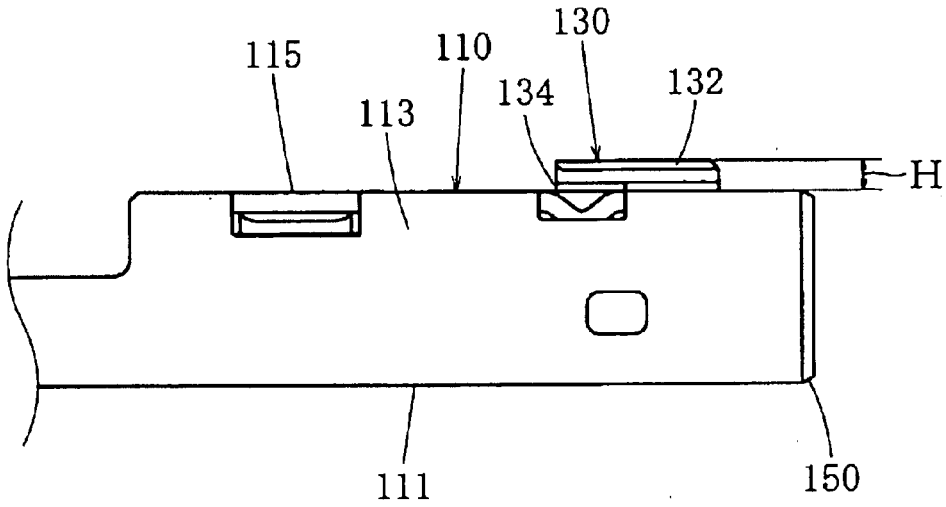
FIG. 3 is an enlarged partial view of the body of the terminal of the first embodiment seen in the width direction.
Figure 4:
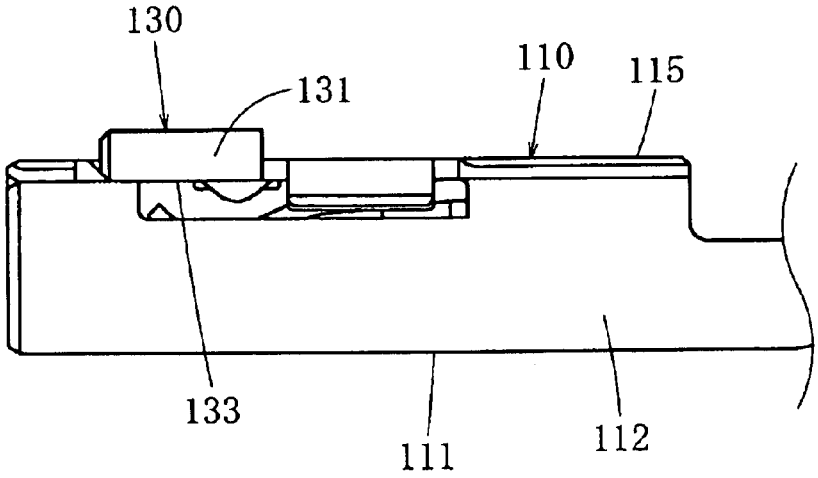
FIG. 4 is an enlarged partial view of the body of the terminal of the first embodiment seen from the other side in the width direction.
Figure 5:
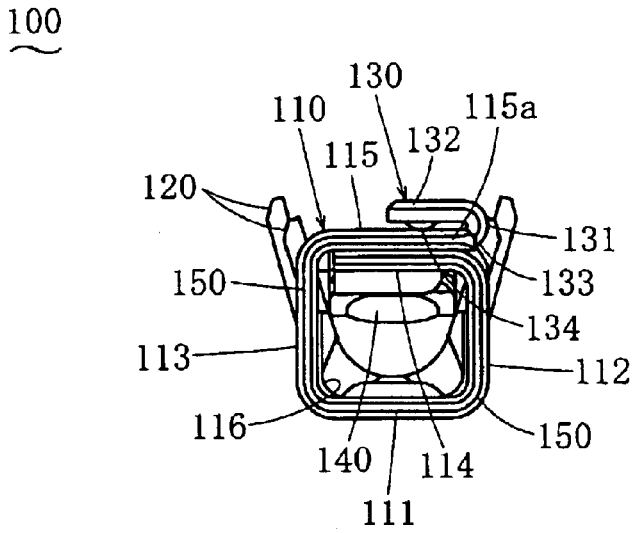
FIG. 5 is an enlarged view of the body of the terminal of the first embodiment seen from the front in the depth direction.
Figure 6:
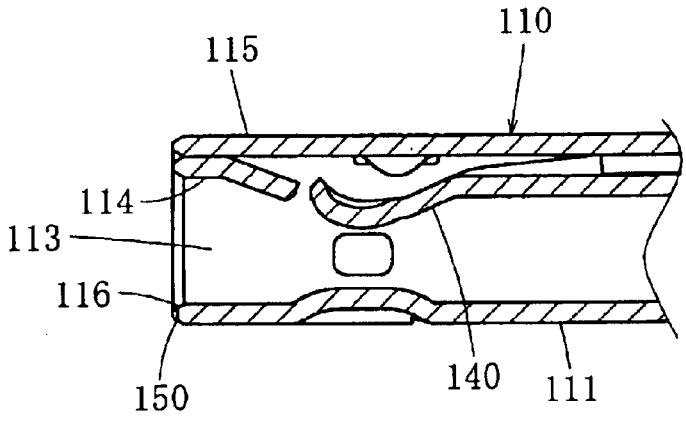
FIG. 6 is an enlarged sectional view of the body of the terminal of the first embodiment seen in the width direction.

The terminal 100 is made of a conductive material. The terminal 100 comprises a body 110 to be connected to a counterpart terminal, a connecting part 120 extending from this body 110 rearward in the depth direction and to be connected to the electric wire W being a conductor, and a laid-down protruding piece 130 provided on the body 110. A depth direction, a width direction and a thickness direction all being perpendicular to each other are assumed, and the following description is given by using this orientation. In the case of this embodiment, with reference to FIG. 2, the left-right direction of FIG. 2 is the depth direction, the right of FIG. 2 is the rear in the depth direction, and the left of FIG. 2 is the front in the depth direction. The top-bottom direction of FIG. 2 is the width direction, and a direction perpendicular to the plane of the paper of FIG. 2 is the thickness direction.

The body 110 is formed into a rectangular tube that comprises a cross plate 111, a first vertical plate 112 and a second vertical plate 113 both bending from both ends in the width direction of the cross plate 111 and rising to one side of the thickness direction, an inner plate 114 bending from the first vertical plate 112 and extending in the width direction close to the second vertical plate 113, and an outer plate 115 bending from the second vertical plate 113 and extending in the width direction close to the first vertical plate 112 to overlap with the inner plate 114. As this terminal 100 is of a female-type, an opening 116 is formed at the front in the depth direction of the body 110 by edges of the cross plate 111, the first vertical plate 112, the second vertical plate 113, the inner plate 114 and the outer plate 115.

In the case of this embodiment, as the terminal 100 is of a crimp-type, the connecting part 120 comprises barrels that crimp and connect the electric wire W. The barrels are an insulation barrel and a wire barrel that are known well. As the present invention can be applied extensively to other types of terminals such as terminals of insulation displacement type or terminals of piercing type, the connecting part is provided to suit a given type.

The laid-down protruding piece 130 bends from the end 115*a* in the width direction of the outer plate 115 of the body 110 to reverse in the width direction and extends in the width direction. The end 115*a* in the width direction of the outer plate 115 is, of the both ends in the width direction of the outer plate 115, the end 115*a* that is closer to the first vertical plate 112. In the thickness direction the outer plate 115 is located between the laid-down protruding piece 130 and the inner plate 114. In the case of this embodiment, the laid-down protruding piece 130 bends from the above-mentioned end 115*a* by 180 degrees approx., then extends in the width direction. The angle of this reversal, however, is not limited to 180 degrees. When this angle is set at 180 degrees, the production of the terminal 100 may be relatively easier than other cases. The width of the laid-down protruding piece 130 is made equal to or narrower than the width of the outer plate 115. The depth of the laid-down protruding piece 130 is made equal to or smaller than the depth of the outer plate 115. The laid-down protruding piece 130 and the outer plate 115 may contact each other or may be spaced from each other in the thickness direction. In the latter case, if the laid-down protruding piece 130 is spaced from the outer plate 115 by a certain distance in the thickness direction, a dimension H from the outer face of the outer plate 115 to the outer face of the laid-down protruding piece 130 can be secured. Hence the function of guiding the terminal 100 to the predetermined position inside the receiving cell 210, the function of being fitted on the flexible piece 230 of the housing 200 and the function of preventing the terminal 100 from being inserted into the housing 200 the other way are exhibited more effectively. Moreover, as the radius of curvature of a part 131 of the laid-down protruding piece 130 that bends from the end 115*a* in the width direction of the outer plate 115 to reverse in the width direction gets larger, this has a merit of preventing generation of cracks and is preferable.

Inside the body 110 a spring 140 is provided, which is displaced in a direction that crosses the depth direction, for example, the thickness direction or the width direction. When the tab of a male terminal is inserted into the body 110, the spring 140 will contact the tab to give a contact pressure against the tab due to the elastic restoring force of the spring 140. In this embodiment, a part of the inner plate 114 is cut and raised to provide a cantilevered leaf, of which top end portion is displaced in the thickness direction, and this is used as the spring 140. However, the structure of the spring of the terminal of the present invention is not limited in any way by this structure, and the present invention includes embodiments of the terminal that are not provided with the spring.

The laid-down protruding piece 130's part 131 that bends from the end 115*a* in the width direction of the outer plate 115 to reverse in the width direction is formed to draw an arc when seen in the depth direction.

The laid-down protruding piece 130's part opposing to the outer plate 115 is provided with a protruding part 134 that protrudes in the thickness direction and contact the outer plate 115. In the case of this embodiment, the protruding part 134 is formed by a bead or a lib, for example, extending in the depth direction or in the width direction or a direction in between them for a certain length. The protruding part may be provided by a dimple that does not extend but protrude locally. The protruding part 134 is formed to have an approximately-U-shaped or V-shaped section when sectioned in a plane perpendicular to the depth direction, but the configuration of the protruding part 134 is not limited by this in any way.

In the case of this embodiment, the protruding part 134 is provided up to the rear end in the depth direction of the laid-down protruding piece 130. To be more specific, the protruding part 134 extends from the central part of the laid-down protruding piece 130 up to the rear end thereof in the depth direction.

A corner 132 at the front in the depth direction and at the top end in the width direction of the laid-down protruding piece 130 is chamfered when seen in the thickness direction.

The circumferential edges of the face of the terminal 100 facing frontward in the depth direction are chamfered to form chamfered parts 150.

Chamfering of such parts include not only the narrow-sense chamfering wherein inclined straight faces are formed but also the R-chamfering (round-chamfering) wherein chamfered faces are formed by like drawing an arc. In other words, the above-mentioned corner 132 may be formed, as shown in FIG. 2, so that the circumferential edge draws an arc when seen in the thickness direction, or the circumferential edge shows an inclined straight line. The circumferential edges of the face of the terminal 100 facing frontward in the depth direction may be formed so that the contour of the section thereof when sectioned in a plane facing the width direction or a plane facing the thickness direction have inclined straight lines or draw arcs.

In the case of this embodiment, as shown in FIG. 2, the corner 132 at the front in the depth direction and at the top end in the width direction of the laid-down protruding piece 130 is R-chamfered so that the circumference draws an arc when seen in the thickness direction. Moreover, in the case of this embodiment, the chamfered parts 150 that are made on the circumferential edges of the face facing frontward in the depth direction of the terminal 100 are chamfered in the narrow sense.

Figure 8:
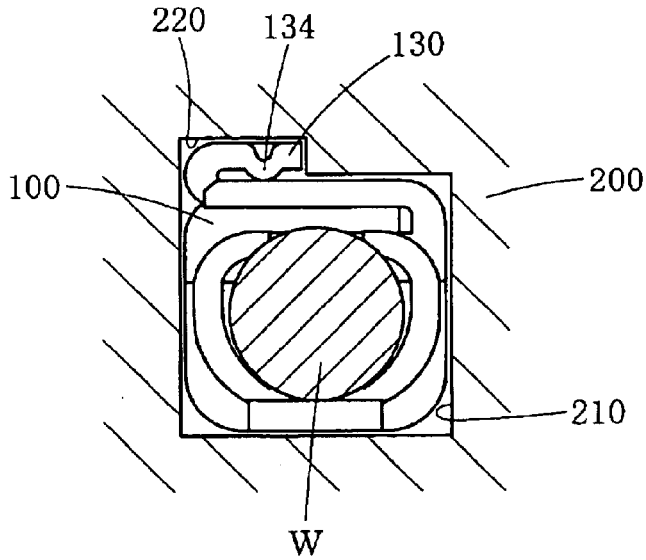
FIG. 8 is an enlarged sectional view of the nonwaterproof electric connector of the first embodiment seen from the rear in the depth direction.

FIG. 7 and FIG. 8 show a nonwaterproof electric connector C1, wherein terminals 100 are inserted into and fitted on a housing 200. The orientation of the housing 200 is similar to that explained above. With reference to FIG. 8, the direction perpendicular to the paper plane of the diagram is the depth direction, and the verso of the paper of the diagram is the front in the depth direction, and the right side of the paper of the diagram is the rear in the depth direction. The top-bottom direction of FIG. 8 is the thickness direction, and the left-right direction is the width direction. The nonwaterproof electric connector C1 of this embodiment is provided with two stages of receiving cells, and each stage has a plurality of receiving cells arranged in parallel to each other. This, however, does not limit in any way the number of poles nor the layout of poles of the electric connector on which the terminal of the present invention is fitted.

At least the part of the housing 200 that the terminal 100 contacts is made of an insulative material. The housing 200 is provided with receiving cells 210 penetrating the housing 200 in the depth direction, into which the terminals 100 with electric wire W connected thereto are to be inserted. The housing 200 is provided with guide grooves 220 that are concaved from the receiving cells 210 in the thickness direction. These guide grooves 220 extend in the depth direction. The housing 200 is provided with cantilevered flexible pieces 230 that extend from the rear toward the front in the depth direction. A portion near the top end of each flexible piece 230 protrudes into the guide groove 220. 240 denotes a fitting member, and this fitting member 240 is located in such a position that the fitting member 240 does not interfere with the inside of the receiving cell 210 when the terminal 100 is inserted into the housing 200 or is withdrawn from the housing 200. When the terminal 100 is inserted into a predetermined position inside the housing 200, the fitting member 240 will be pushed in the width direction and in turn will be slid in the width direction, and as shown in FIG. 7, will be fitted on the rear side in the depth direction of the body 110 of the terminal 100, and this in turn will fit the terminal 100 on the housing 200. The terminal of the present invention includes embodiments wherein such a fitting member 240 is not provided.

Figure 9:
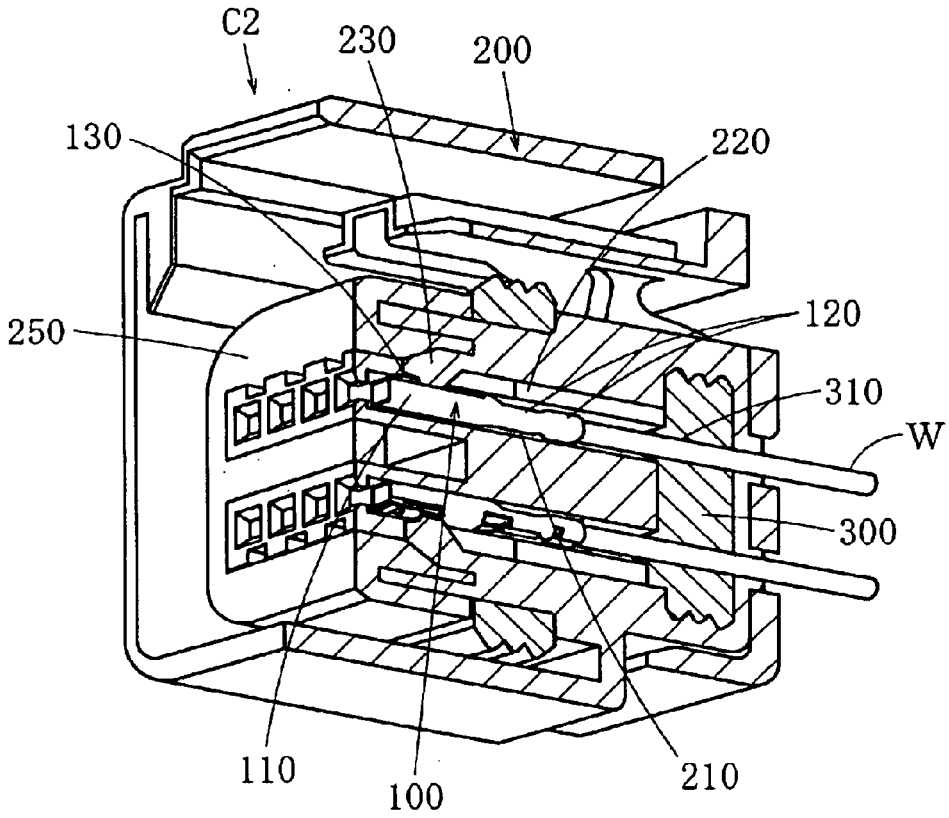
FIG. 9 is a perspective view showing in section a waterproof electric connector of the first embodiment.

FIG. 9 shows a waterproof electric connector C2, wherein the terminals 100 are inserted into and fitted on a housing 200. This housing 200 is also provided with receiving cells 210, guide grooves 220 and flexible pieces 230 in a configuration similar to that of the housing of the nonwaterproof electric connector C1. Moreover, this housing 200 is provided with a sealing member 300 on the rear side in the depth direction of the receiving cells 210 to secure watertightness of the receiving cells 210. The sealing member 300 is provided with through holes 310 for passing an electric wire W in the depth direction. 250 denotes a fitting member. When the terminals 100 are to be inserted into or withdrawn from the housing 200, this fitting member 250 is located more frontward in the depth direction than its position shown in FIG. 9, and in that position the fitting member 250 does not interfere with the flexible pieces 230. And after the terminals 100 are inserted into the predetermined positions inside the housing 200 and the laid-down protruding pieces 130 are fitted on the flexible pieces 230, the fitting member 250 will be pushed rearward in the depth direction to slide in the same direction, and as shown in FIG. 9, the fitting member 250 will be forced into the spaces on the back of the flexible pieces 230. This prevents the flexible pieces 230 from being pushed in a direction of undoing their fitting on the laid-down protruding pieces 130. The terminal according to the present invention includes embodiments wherein such a fitting member 250 is not provided.

Accordingly, when the terminal 100 is inserted into the receiving cell 210 of the housing 200, the laid-down protruding piece 130 will be guided by the guide groove 220 to move frontward in the depth direction, push away the flexible piece 230 in the thickness direction and come to a position on the front side in the depth direction of the flexible piece 230. Then the flexible piece 230 will elastically restore itself to enter into a space on the rear side in the depth direction of the laid-down protruding piece 130 and fit on it. Moreover, as shown in FIG. 8, the terminal 100 and the receiving cell 210 are provided asymmetrically when seen in the depth direction, hence the terminal 100 can be inserted only when the laid-down protruding piece 130 and the guide groove 220 are put together. If the direction of the terminal 100 is reversed in the thickness direction, the terminal 100 can not be inserted. Thus insertion of the terminal 100 in a wrong direction can be prevented. In short, the laid-down protruding piece 130 exhibits a function of guiding the terminal 100 into the predetermined position inside the receiving cell 210, a function of being fitted on the flexible piece 230 of the housing 200 and a function of preventing the terminal 100 from being inserted into the housing 200 the other way.

Figure 10:
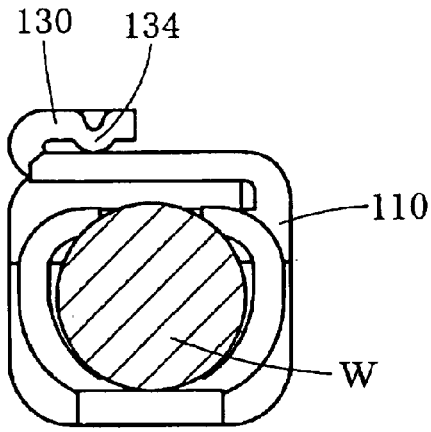
FIG. 10 is an enlarged view of the terminal of the first embodiment with an electric wire connected thereto seen from the rear in the depth direction.
Figure 11:
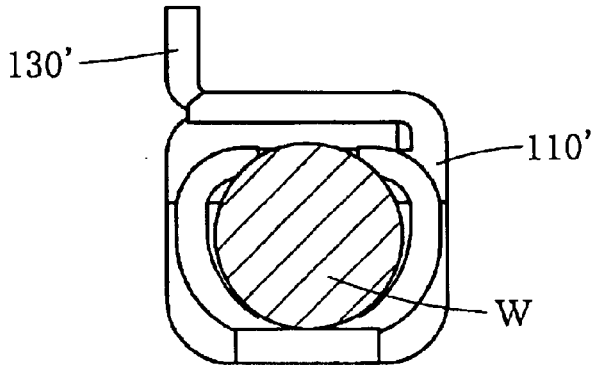
FIG. 11 is a diagram showing a comparative example to facilitate the description. It is an enlarged view of the terminal of a comparative example with an electric wire connected thereto seen from the rear in the depth direction.
Figure 12:
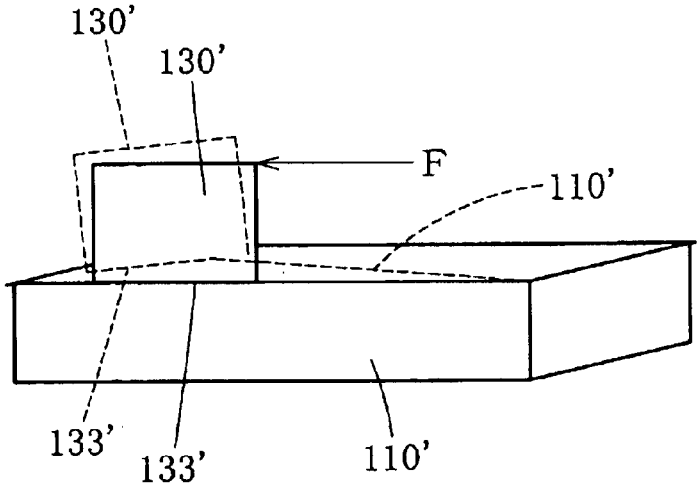
FIG. 12 is a diagram showing the schematically drawn comparative example to explain the action of a bending moment.

In that case, as the body 110 is formed into a rectangular tube that comprises the cross plate 111, the first vertical plate 112 and the second vertical plate 113 both bending from the cross plate 111, and the inner plate 114 and the outer plate 115 bending from the vertical plates 112, 113, respectively and overlapping each other, the strength of the terminal 100 is secured by this arrangement. In other words, as the joining part of the body 110 is provided by overlapping the inner plate 114 and the outer plate 115 each other, even if the body 110 is subjected to an external force, the external force will be dispersed to both the inner plate 114 and the outer plate 115, and they will bear the external force jointly. Hence the strength is enhanced. The laid-down protruding piece 130 bends from the end 115*a* in the width direction of the outer plate 115 of the body 110 to reverse in the width direction and extends in the width direction, and the width of the laid-down protruding piece 130 is equal to or narrower than the width of the outer plate 115. Accordingly, the amount of protrusion of the laid-down protruding piece 130 from the body 110 is smaller when compared with the case wherein the laid-down protruding piece 130' is raised in the thickness direction from the body 110' (refer to FIG. 10 showing the embodiment and FIG. 11 showing a comparative example for easier description). As a result, when the terminal 100 is used in the waterproof electric connector C2, the terminal 100 is inserted and assembled in the waterproof electric connector C2 or the terminal 100 is withdrawn and removed from the waterproof electric connector C2. At that time, even when the terminal 100 is passed through the sealing member 300 of the waterproof electric connector C2, the terminal 100 will not damage the circumferential wall of the hole 310 of the sealing member 300. Hence this terminal 100 can be used in the waterproof electric connector C2 without damaging the sealing member 300 and, in turn, can be used as a component common to both the waterproof electric connector C2 and the nonwaterproof electric connector C1. Moreover, in the case of the above-mentioned comparative example, as shown in FIG. 12, for example, if a force F works on the top end of the protruding piece 130' in the depth direction as shown by the arrow in the diagram, causing a large bending moment at the root end 133' of the protruding piece 130', the body 110', for example, will be deformed as shown in the diagram by broken lines or the spring will be deformed. In contrast to this, in the case of the terminal of the embodiment, as the amount of protrusion of the laid-down protruding piece 130 from the body 110 is reduced, the bending moment working at the root end 133 of the laid-down protruding piece 130 is smaller and the load on the body 110 is reduced. This and the enhanced strength of the body 110 through the use of the above-mentioned structure in combination reliably prevent deformation of the body 110 and the spring 140.

In the case of the terminal of the present invention, the configuration of the laid-down protruding piece's part to be bended is not limited. Among the embodiments, in the case of the terminal 100 of this embodiment, the part 131 of the laid-down protruding piece 130, which bends from the end 115*a* in the width direction of the outer plate 115 of the body 110 to reverse in the width direction, is formed to draw an arc when seen in the depth direction. With this arrangement, no edge is formed on the bending part 131, hence the terminal 100 is more reliably prevented from damaging the circumferential wall of the hole 310 of the sealing member 300 even when the terminal 100 is made to pass through the sealing member 300 of the waterproof electric connector C2.

In the case of the terminal of the present invention, the configuration of the laid-down protruding piece is not limited. It may be a flat plate or a bent plate, or the laid-down protruding piece may contact the outer plate or it may not contact the outer place. Among them, in the case of the terminal 100 of the embodiment, the laid-down protruding piece 130's part opposing to the outer plate 115 is provided with a protruding part 134 that protrudes in the thickness direction and contacts the outer plate 115. With this arrangement, the dimension H from the outer face of the outer plate 115 to the outer face of the laid-down protruding piece 130 (refer to FIG. 3) is stabilized by the protruding part 134 contacting the outer plate 115, and the above-mentioned dimension H is prevented from dispersion. The above-mentioned dimension H can be adjusted by adjusting the amount of protrusion of the protruding part 134.

When the protruding part is to be provided, it may be provided in any range on the laid-down protruding piece. In the embodiment the protruding part 134 is provided up to the rear end in the depth direction of the laid-down protruding piece 130. With this arrangement, as the area of the rear end in the depth direction of the laid-down protruding piece is expanded, the force of the flexible piece 230 of the housing 200 to fit on the laid-down protruding piece 130 will be increased.

In the case of the terminal of the present invention, the configuration of the top end of the laid-down protruding piece is not limited. Among them, in the terminal 100 of the embodiment, the corner 132 at the front in the depth direction and at the top end in the width direction of the laid-down protruding piece 130 is chamfered when seen in the thickness direction. With this arrangement, as no sharp edge is formed on the corner 132, the terminal 100 is more reliably prevented from damaging the circumferential wall of the hole 310 of the sealing member 300 even when the terminal 100 is made to pass through the sealing member 300 of the waterproof electric connector C2.

In the case of the terminal of the present invention, the configuration near the face facing frontward in the depth direction is not limited. Among them, in the case of the terminal 100 of the embodiment, the circumferential edges of the face facing frontward in the depth direction are chamfered to form chamfered parts 150. With this arrangement, as no sharp edges are formed on the circumferential edges of the face facing frontward in the depth direction, the terminal 100 is more reliably prevented from damaging the circumferential wall of the hole 310 of the sealing member 300 even when the terminal 100 is made to pass through the sealing member 300 of the waterproof electric connector C2.

In the case of the terminal 100 of the embodiment, the corner 132 at the front in the depth direction and at the top end in the width direction of the laid-down protruding piece 130 is formed to draw an arc when seen in the thickness direction and R-chamfered. As a result, sharp edges are reduced furthermore. Hence the terminal 100 is more reliably prevented from damaging the circumferential wall of the hole 310 of the sealing member 300 even when the terminal 100 is made to pass through the sealing member 300 of the waterproof electric connector C2. Similarly, when the chamfered parts 150 of the circumferential edges of the face facing frontward in the depth direction of the terminal 100 are R-chamfered, sharp edges are reduced further. Thus the terminal 100 is more reliably prevented from damaging the circumferential wall of the hole 310 of the sealing member 300 even when the terminal 100 is made to pass through the sealing member 300 of the waterproof electric connector C2.

Figure 13:
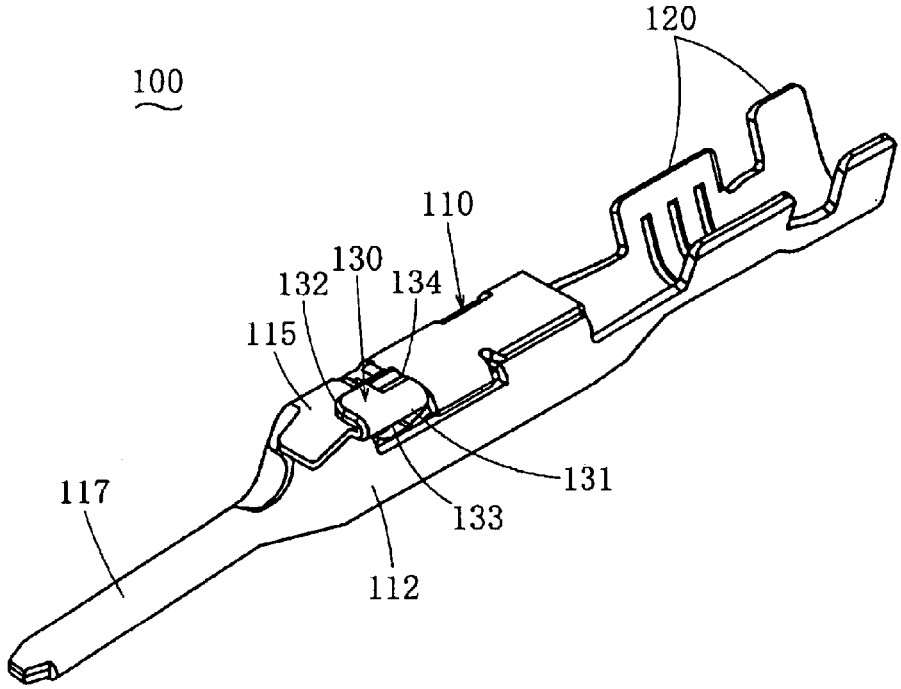
FIG. 13 is a perspective view showing the terminal of the second embodiment.
Figure 14:
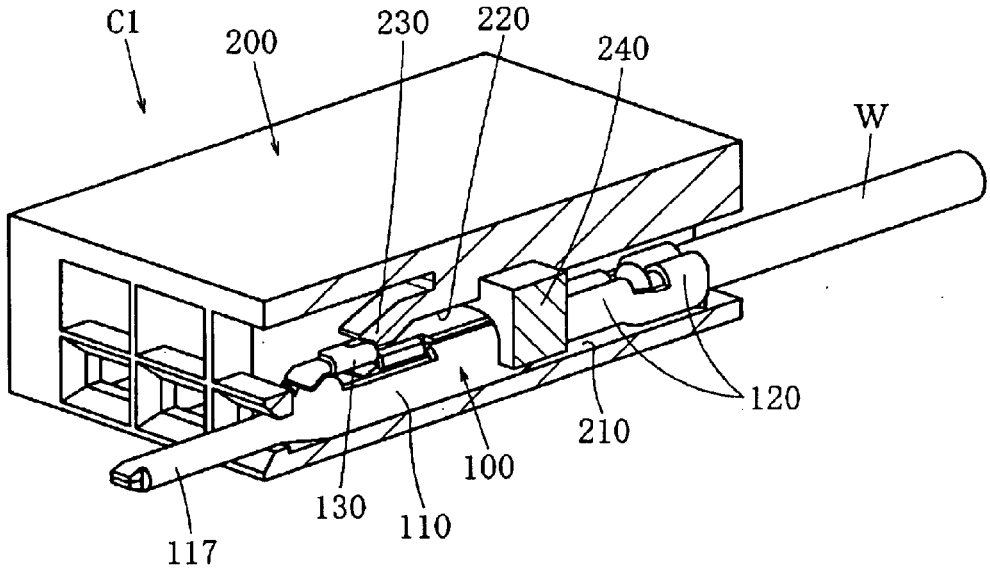
FIG. 14 is a perspective view showing in section a nonwaterproof electric connector of the second embodiment.
Figure 15:
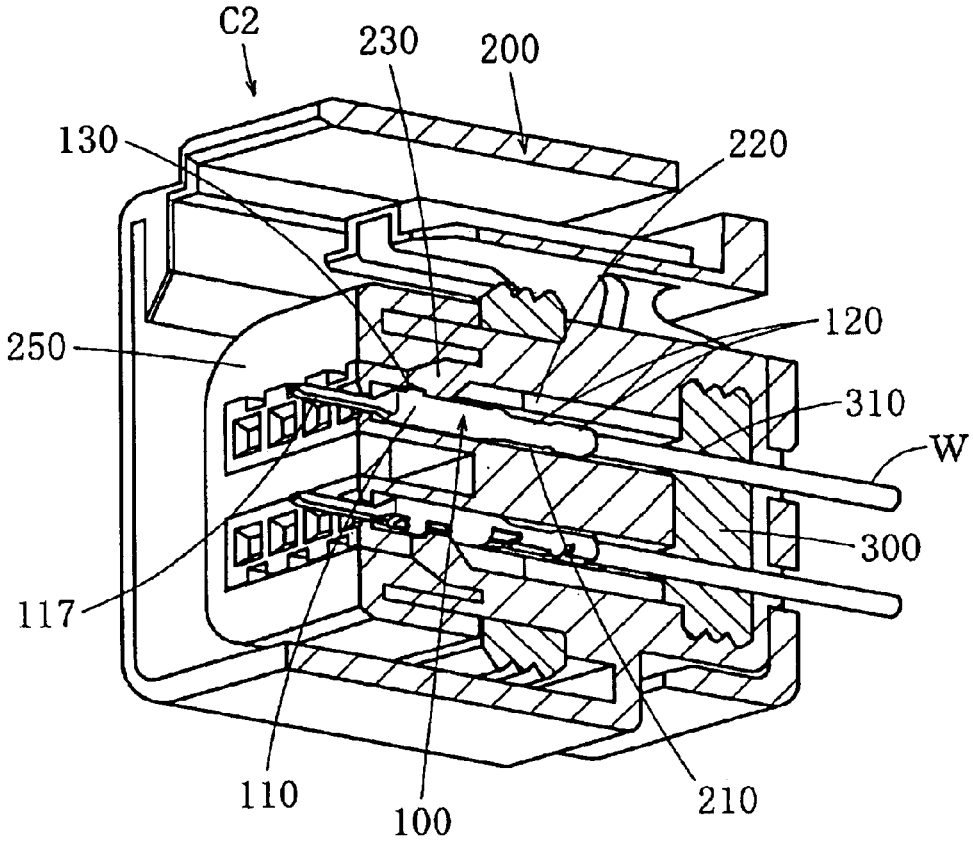
FIG. 15 is a perspective view showing in section a waterproof electric connector of the second embodiment.

FIG. 13 through FIG. 15 show the terminal 100 of the second embodiment. The terminal 100 of the first embodiment is a terminal of a female-type. In contrast to it, the terminal 100 of the second embodiment is a terminal of a male-type. Accordingly, a tab 117 is provided at the front in the depth direction of the body 110, the tab 117 being extended and formed from at least a part of the cross plate 111, the first vertical plate 112, the second vertical plate 113, the inner plate 114 and the outer plate 115. In the case of this embodiment, the tab 117 is formed by plates extending frontward from the cross plate 111 and the first vertical plate 112, but the structure is not limited to this specific one. The functions and effects of the terminal 100 of the second embodiment are similar to those of the first embodiment.

In the cases of the above-mentioned embodiments, the laid-down protruding piece 130 exhibits all of the function of guiding the terminal 100 to the predetermined position inside the receiving cell 210, the function of being fitted on the flexible piece 230 of the housing 200 and the function of preventing the terminal 100 from being inserted into the housing 200 the other way. The present invention includes terminals with a laid-down protruding piece that exhibits at least one of these functions.

The present invention includes embodiments wherein features of the embodiments described above are combined.

With the description of these embodiments, the first terminal that was described in the summary of the invention has been fully described. Moreover, with the description of these embodiments, the second terminal through the seventh terminal that are described below have been fully explained. The present invention includes these terminals.

The second terminal is the first terminal, wherein the laid-down protruding piece's part bending from the end in the width direction of the outer plate to reverse in the width direction is formed to draw an arc when seen in the depth direction.

With this arrangement, as no edge is formed on the bending part, the terminal is more reliably prevented from damaging the circumferential wall of the hole of the sealing member of the waterproof electric connector even when the terminal is made to pass through the sealing member.

The third terminal is the first terminal or the second terminal, wherein the laid-down protruding piece's part opposing to the outer plate is provided with a protruding part that protrudes in the thickness direction and contacts the outer plate.

With this arrangement, the dimension from the outer face of the outer plate to the outer face of the laid-down protruding piece is stabilized by making the protruding part contact the outer plate, and dispersion of the above-mentioned dimension among products can be prevented. The above-mentioned dimension can be adjusted by changing the amount of protrusion of the protruding part.

The fourth terminal is the third terminal, wherein the protruding part is provided up to the rear end in the depth direction of the laid-down protruding piece.

With this arrangement, as the area of the rear end in the depth direction of the laid-down protruding piece is increased, the force of the flexible piece of the housing for fitting on the laid-down protruding piece will be enhanced.

The fifth terminal is any one of the first through fourth terminals, wherein the corner at the front in the depth direction and at the top end in the width direction of the laid-down protruding piece is chamfered when seen in the thickness direction.

With this arrangement, as no sharp edge is formed on this corner, the terminal is more reliably prevented from damaging the circumferential wall of the hole of the sealing member of the waterproof electric connector even when the terminal is made to pass through the sealing member.

The sixth terminal is any one of the first through fifth terminals, wherein the circumferential edges of the face of the terminal facing frontward in the depth direction are chamfered.

With this arrangement, as no sharp edges are formed on the circumferential edges of the face facing frontward in the depth direction, the terminal is more reliably prevented from damaging the circumferential wall of the hole of the sealing member of the waterproof electric connector even when the terminal is made to pass through the sealing member.

The seventh terminal is the fifth terminal or the sixth terminal, wherein chamfer is R-chamfer that is formed by like drawing an arc.

With this arrangement, as sharp edges are reduced further, the terminal is more reliably prevented from damaging the circumferential wall of the hole of the sealing member of the waterproof electric connector even when the terminal is made to pass through the sealing member.

What is claimed is:

1. A terminal comprising when a depth direction, a width direction and a thickness direction all being perpendicular to each other are assumed, a rectangular-tube-shaped body having an opening or a tab at the front in the depth direction thereof and having a cross plate, a first vertical plate and a second vertical plate bending from both ends in the width direction of the cross plate and rising to one side in the thickness direction, an inner plate bending from the first vertical plate and extending in the width direction close to the second vertical plate, and an outer plate bending from the second vertical plate and extending in the width direction close to the first vertical plate to overlap with the inner plate, a connecting part extending from the body rearward in the depth direction and to be connected to a conductor, and a laid-down protruding piece bending upwardly from the end in the width direction of the outer plate of the body to reverse in the width direction, extending in the width direction and having a width equal to or narrower than the width of the outer plate.

2. The terminal as recited in claim 1, wherein the laid-down protruding piece's part bending from the end in the width direction of the outer plate to reverse in the width direction is formed to draw an arc when seen in the depth direction.

3. The terminal as recited in claim 1, wherein the laid-down protruding piece's part opposing to the outer plate is provided with a protruding part that protrudes in the thickness direction and contact the outer plate.

4. The terminal as recited in claim 2, wherein the laid-down protruding piece's part opposing to the outer plate is provided with a protruding part that protrudes in the thickness direction and contact the outer plate.

5. The terminal as recited in claim 3, wherein the protruding part is provided up to the rear end in the depth direction of the laid-down protruding piece.

6. The terminal as recited in claim 4, wherein the protruding part is provided up to the rear end in the depth direction of the laid-down protruding piece.

7. The terminal as recited in claim 1, wherein the corner at the front in the depth direction and at the top end in the width direction of the laid-down protruding piece is chamfered when seen in the thickness direction.

8. The terminal as recited in claim 2, wherein the corner at the front in the depth direction and at the top end in the width direction of the laid-down protruding piece is chamfered when seen in the thickness direction.

9. The terminal as recited in claim 3, wherein the corner at the front in the depth direction and at the top end in the width direction of the laid-down protruding piece is chamfered when seen in the thickness direction.

10. The terminal as recited in claim 4, wherein the corner at the front in the depth direction and at the top end in the width direction of the laid-down protruding piece is chamfered when seen in the thickness direction.

11. The terminal as recited in claim 1, wherein the circumferential edges of the face of the terminal facing frontward in the depth direction are chamfered.

12. The terminal as recited in claim 2, wherein the circumferential edges of the face of the terminal facing frontward in the depth direction are chamfered.

13. The terminal as recited in claim 3, wherein the circumferential edges of the face of the terminal facing frontward in the depth direction are chamfered.

14. The terminal as recited in claim 4, wherein the circumferential edges of the face of the terminal facing frontward in the depth direction are chamfered.

15. The terminal as recited in claim 7, wherein the circumferential edges of the face of the terminal facing frontward in the depth direction are chamfered.

16. The terminal as recited in claim 8, wherein the circumferential edges of the face of the terminal facing frontward in the depth direction are chamfered.

17. The terminal as recited in claim 9, wherein the circumferential edges of the face of the terminal facing frontward in the depth direction are chamfered.

18. The terminal as recited in claim 10, wherein the circumferential edges of the face of the terminal facing frontward in the depth direction are chamfered.

19. The terminal as recited in claim 7, wherein chamfer is R-chamfer that is formed by like drawing an arc.

20. The terminal as recited in claim 11, wherein chamfer is R-chamfer that is formed by like drawing an arc.

* * * * *